United States Patent [19]

Christian

[11] 4,421,219

[45] Dec. 20, 1983

[54] DUAL PRICE CAM SYSTEM FOR TOTALIZING VENDOR

[76] Inventor: Donald K. Christian, 119 Woodbine Ter., Spartanburg, S.C. 29301

[21] Appl. No.: 298,204

[22] Filed: Aug. 31, 1981

[51] Int. Cl.[3] ..... G07F 5/20

[52] U.S. Cl. ..... 194/1 L; 194/94

[58] Field of Search ..... 194/1 G, 1 L, 94, DIG. 3

[56] References Cited

U.S. PATENT DOCUMENTS

| | | | |
|---|---|---|---|
| 3,578,127 | 5/1971 | Verbeke | 194/71 |
| 3,921,779 | 11/1975 | Pearson | 194/1 L |
| 3,929,212 | 12/1975 | Burzen | 194/1 L |
| 4,037,701 | 7/1977 | Knickerbocker | 194/1 L |
| 4,049,106 | 9/1977 | Chalabian | 194/1 G X |
| 4,093,058 | 6/1978 | Terry | 194/71 |
| 4,122,729 | 10/1978 | Mitchel | 194/1 G X |

*Primary Examiner*—F. J. Bartuska

[57] ABSTRACT

A multiple price system for a vending machine wherein an intermediate member is selectively interposed between a price cam and a product release device to alter the price at which a product is made available to a purchaser.

4 Claims, 6 Drawing Figures

DUAL PRICE CAM SYSTEM FOR TOTALIZING VENDOR

BACKGROUND OF THE INVENTION

The merchandising of newspapers through vending machines has developed through many and varied apparatuses from the time when in U.S. Pat. No. 601,189 Welch referred to a newspaper vendor that accepted one or more pennies until today when at least one of our larger publishers is selling one of its editions for one or more dollars. To further complicate matters, nearly all publishers today charge more for at least one of their week-end editions than they do for their daily editions.

U.S. Pat. Nos. 3,760,924 Voegeli and 3,884,330 Chalabian both teach the use of vertical coin slots with sensing pawls to release the access door of a newspaper vendor. With a small number of like coins or even with simple combinations of coins these vendors have, in the past, been proven quite satisfactory. Both the aforementioned have provided within the coin mechanism a means for making said mechanism responsive to a first and then a second price. U.S. Pat. No. 4,093,058 Terry, while being substantially the same, teaches an improvement in the use of a remote lock to select between the first and then a second price, thus making it possible for a service person to change the price without having access to the coins which have collected within the vendor.

U.S. Pat. No. 3,921,779 Pearson and 4,037,701 Knickerbocker are still further improvements in that both teach the use of a totalizer, which will accept any combination of coins up to a predetermined price, to control an access door with Knickerbocker teaching the use of a remote lock in the same manner as the heretofore mentioned Terry. Both Pearson and Knickerbocker teach the use of a single price cam and relatively complex resetting apparatus.

SUMMARY OF THE INVENTION

It is an object of the present invention to provide a simple means for selecting between one or two price settings of a newspaper vending machine. It is further the object of this invention to provide a means for using a lock on the outside of a newspaper vendor to select between one of two individual price cams. It is further the object of this invention to provide for fully resetting the totalizer of a duel price newspaper vendor during each vend cycle. It is further the object of this invention to provide a simple and reliable means for increasing the price settings of a newspaper vending machine. It is further the object of this invention to provide a dual price cam system for existing standard vending totalizers.

Generally speaking, the present invention relates to the adaptation of rotary vending totalizers to dual price newspaper vending machines wherein a multiplicity of price cams are provided for the output shaft of said totalizers. An intermediate selector is provided to permit the release of an access door at the lower of two prices.

More specifically, the present invention provides a backing plate, dual price cams and an intermediate selector for a National Rejector Model 13-03-058 S.C.S. totalizer. These facilitate the release of a vending machine access door as taught by the present inventor's co-pending U.S. patent application Ser. No. 226,018 as hereinafter reiterated. An intermediate selector is rotatably associated with said price cams in such manner that it may be oriented in a position wherein it will release said door at the lower of two price settings or, at the discretion of a service person, be so oriented as to prohibit the release of said door at the lower of two price settings. Selection means may be a lock exposed on the outside of subject vendor. A cylinder lock such as a National Lock Co. M4-055 Type 3-J with 3-D cam is provided to give access to said intermediate selector from the outside of the machine.

DESCRIPTION OF THE PREFERRED EMBODIMENTS

Preferred embodiments of the present invention will now be specifically described, making reference to the Figures.

Figure 1:
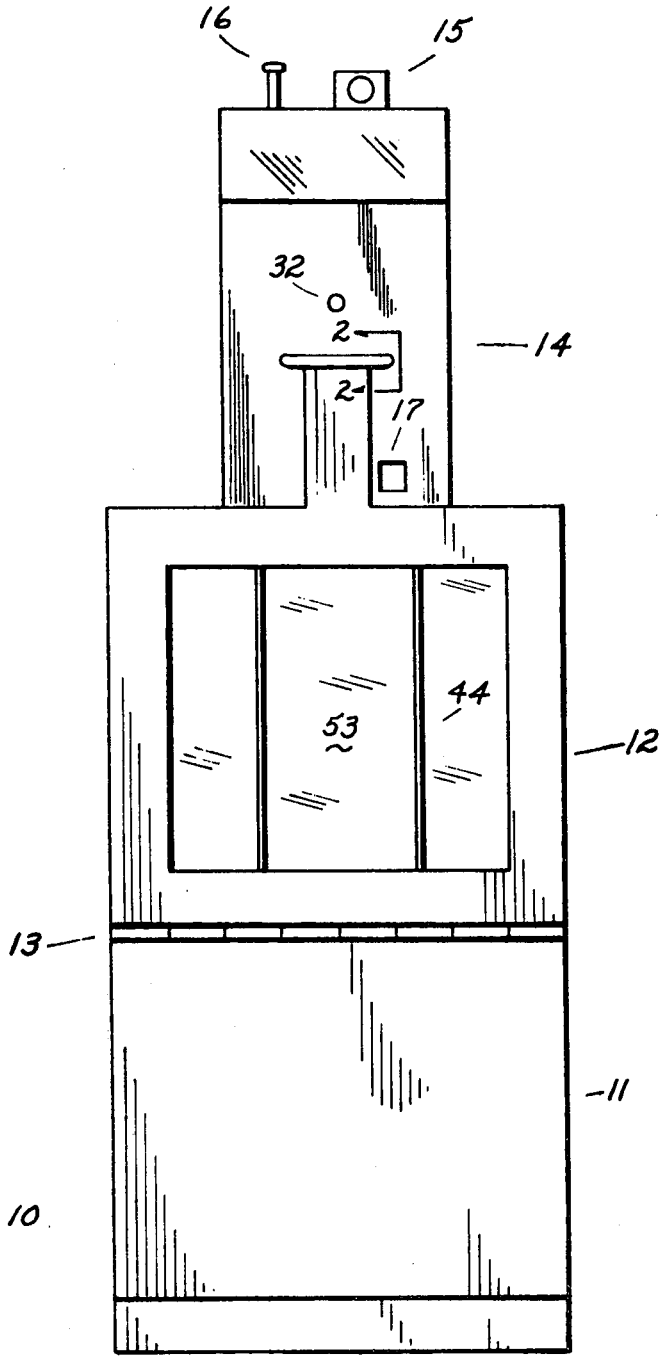
FIG. 1 is a front elevational view of the type newspaper vendor that may be controlled by the invention.

In reference to FIG. 1, vendor 10 is comprised of housing 11, door 12 which is pivotally mounted to said housing by means of spring hinge 13, and upper enclosure 14. Said upper enclosure contains coin insert 15, coin return button 16, coin return chute 17 and locking device 32. Said door contains window 53 and display paper rack 44.

Figure 2:
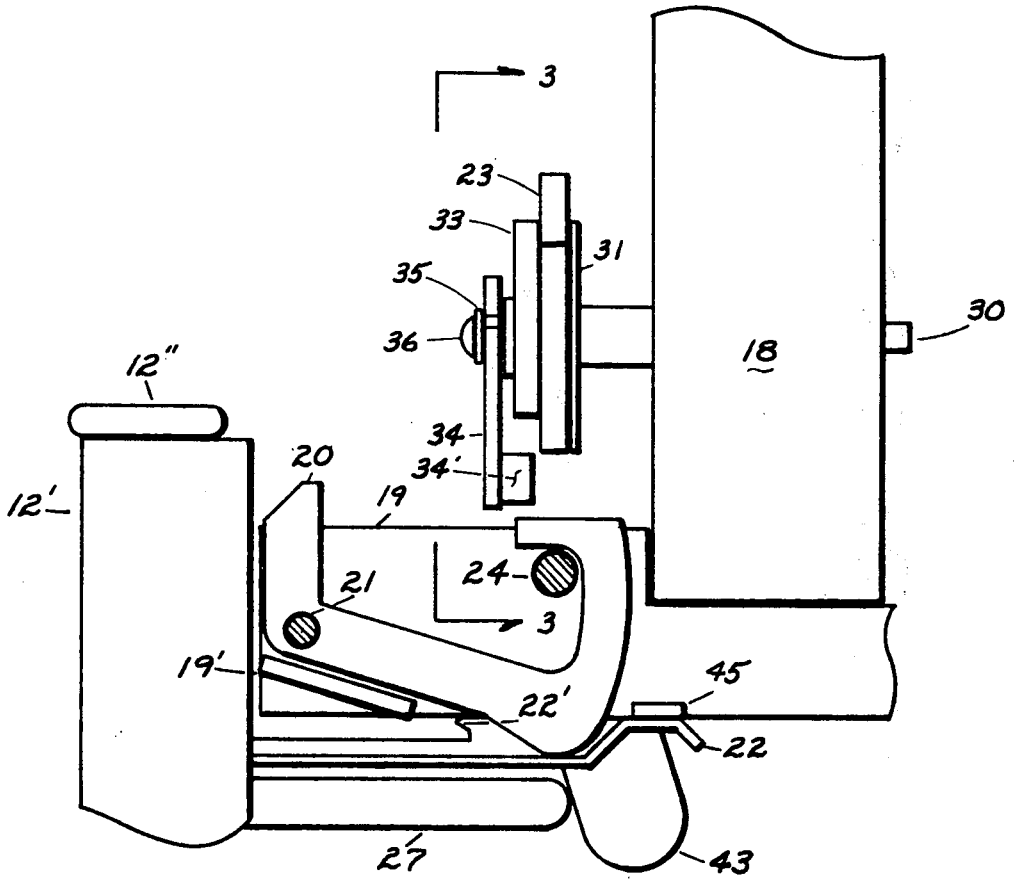
FIG. 2 is a cross-sectional view taken along lines 2—2 of FIG. 1.

In reference to FIG. 2, contained within and affixed to said upper enclosure are standard mechanical vending totalizer 18 and catch assembly 19. Finger 20 is pivotally mounted in catch assembly 19 by means of shaft 21, in turn secured to catch assembly 19. Said finger rests on spring loaded latch 22 generally underneath price cams 23 and 33, intermediate link 34 and back-up plate 31 which is mounted on main shaft 30 of totalizer 18. Spring loaded latch 22, being pivotally mounted within door extension 12' is restrained from its upward travel by latch depressor 45. When coins are inserted in coin insert 15, totalizer module 18, by means not shown but well known to those skilled in the art, separates good coins from bad coins, slugs and the like, conducting rejected items to coin return chute 17. Coin return button 16 is provided to help purge rejected objects from said totalizer module. Such good coins as may be inserted are so separated and conveyed as to cause discrete increments of clockwise rotation of price cams 23 and 33, back-up plate 31 and main shaft 30. For example, one specific model of standard totalizer rotates 9° for each good nickel it senses, 18° for each good dime it senses and 45° for each good quarter it senses. In reference to both FIG. 2 and FIG. 3. If door extension 12' is pulled outward by means of handle 12'', both integral parts of door 12, spring loaded latch 22 moves causing finger 20 to rise as it pivot about shaft 21, thus permitting said latch to rise engaging latch hook 22', an integral part of latch 22, in catch 19' which in turn is affixed to catch assembly 19 thereby preventing door 12 from giving access to the newspapers contained within housing 11.

Figure 4:
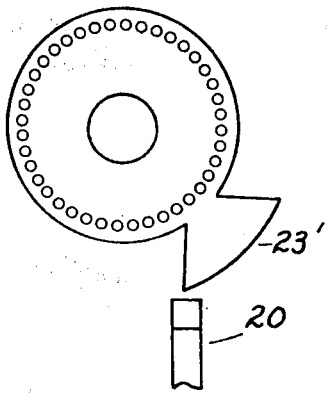
FIG. 4 is a partial view in the same plane as FIG. 3 with intermediate selector and lower price cam removed for clarity.

In reference to FIG. 4 wherein lobe 23' of higher price cam 23 has been rotated to a position generally above and in the upward path of finger 20, door 12 will be permitted to open as finger 20 is restrained by lobe 23' from rising thus forcing latch 22 downward in such manner that hook 22' cannot engage catch 19'.

Figure 3:
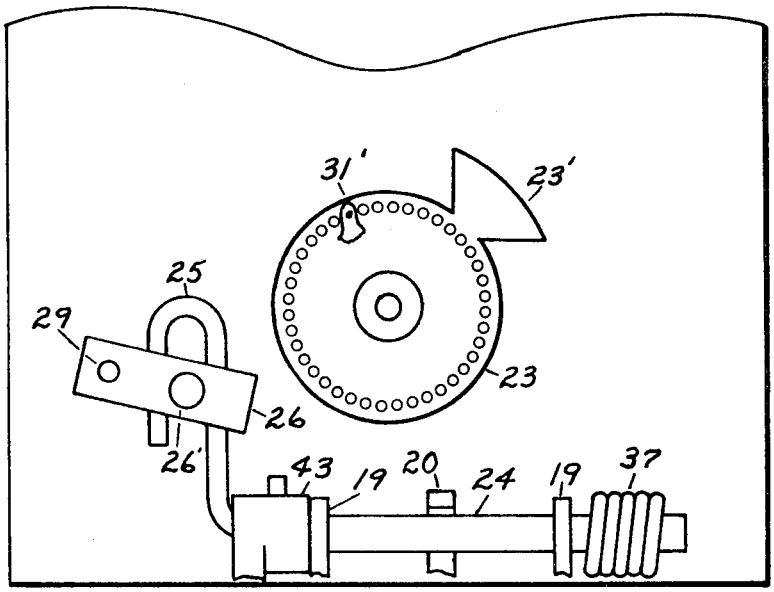
FIG. 3 is a fragmentary view of the output shaft of the totalizer with the intermediate selector and lower price cam removed. This is taken generally along lines 3—3 of FIG. 2.
Figure 5:
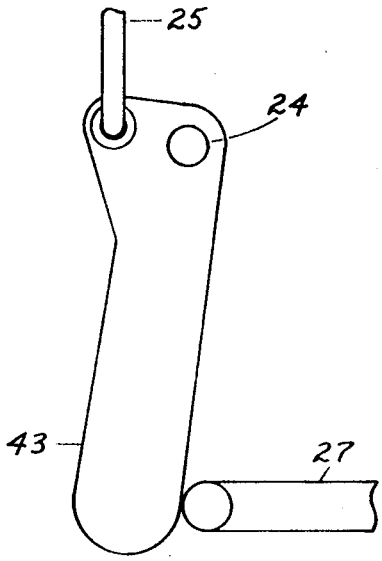
FIG. 5 is a side elevational view of the reset lever.

In reference to FIGS. 2, 3, and 5, reset lever 43 rigidly affixed to shaft 24 is urged in a counter-clockwise fashion by spring 37. Linkage 25 is pivotally engaged with said reset lever and, by its upper loop, restrained in a position of possible contact with pin 26', an integral part of reset arm 26. Rigid member 27, being affixed to door 12 in such manner that when said door is closed said rigid member bearing on reset lever 43 causes linkage 25 to be elevated above its position of engagement with pin 26'. As good coins pass through totalizer 18, higher price cam 23 rotates in a clockwise manner and reset arm 26 in a counter-clockwise manner. When sufficient rotation has been induced to permit the heretofore described door release and opening, rigid member 27 is removed from its position of contact with reset lever 43. Spring 37 causes clockwise rotation of shaft 24 in FIG. 2 or counter-clockwise motion as viewed in FIG. 5. Linkage 25 is brought into forceful contact with pin 26' causing reset arm 26 to pivot downwardly about journal 29. Said reset arm is so interconnected within standard totalizer 18 that clockwise rotation thereof induces counter-clockwise motion of main shaft 30 and cam 23 and a process best described as "resetting" is effected. Fixed stops are provided to restrict said motion when cam 23 has been returned to a pre-determined position or start point, thus readying totalizer 18 for the next sale cycle.

As door 12 is permitted to close by means of spring loaded hinge 13, rigid member 27 again is brought in contact with reset lever 43 resulting in the disengagement of pin 26' and linkage 25 freeing reset arm 26 to rise in concert with the next rotation of price cam 23.

Figure 6:
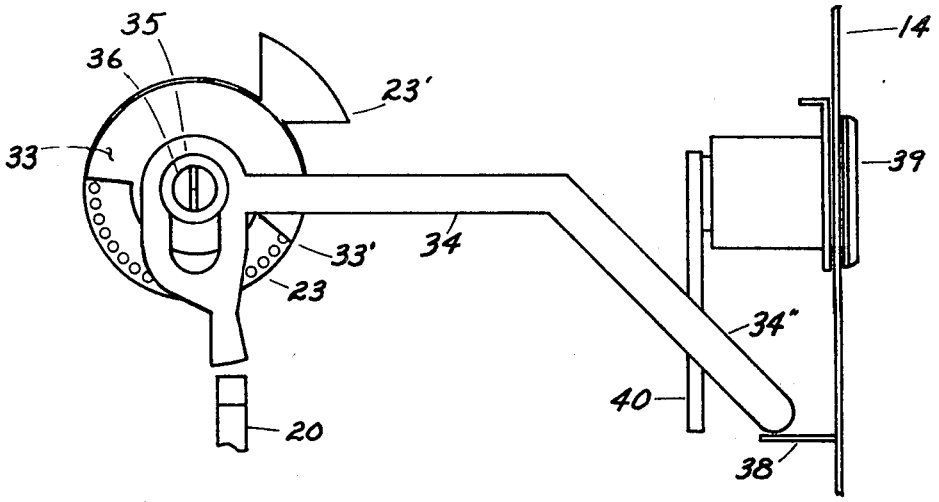
FIG 6 is a frontal view of the totalizer output shaft with higher price cam, lower price cam and intermediate selector in place.

Again in reference to FIGS. 2, 3 and 6, back up plate 31 is provided with appendage 31', an integral part thereof. The higher price cam 23 is provided with a series of holes about its perifery in increments which represent 5¢, any of which will mate with appendage 31'. As higher price cam 23 is removed from its position of engagement with appendage 31' and rotated in a counter clockwise manner, the total value of coins required to release the door is increased. In this instance, more increments of totalizer motion are required to advance main shaft 30 and its rigidly affixed cam 23 to a restraining relationship with finger 20. Conversely clockwise rotation of said cam will lower the total value of coins required to effect release. Model 13-03-058, the totalizer cited, has an incremental value of 5¢.

Lower price cam 33 has, on its back side but not shown, a multiplicity of appendages so oriented as to intersect the series of holes about the perifery of higher price cam 23. Said lower price cam is provided with a boss on its front side in the center with which intermediate selector 34 is loosely associated. Fastener 36 and washer 35 are provided to restrain intermediate selector 34, price cams 23 and 33 and backing plate 31 in right. relationship with main shaft 30. Rest 38 is provided to support arm 34'', an integral portion of intermediate selector 34, substantially in vertical alignment with finger 20 and at a predetermined point in relationship to the path of leading edge 33' of cam 33. Lock 39 and lock cam 40, protruding inward through the side of upper enclosure 14 are provided to lift arm 34'' of intermediate selector 34 thus selectively establishing mis-alignment between finger 20, lower price cam 33 and intermediate link 34'. Intermediate link 34' is an integral part of intermediate selector 34. Rest 38 is fixed to 14.

As coins are deposited in coin mechanism 18, cams 23 and 33 rotate in unison. As leading edge 33' of cam 33 assumes a position of restraining relationship with link 34', said link will impede the upward motion of finger 20 and outward force applied to door handle 12'' will cause latch 22 to cam downward about finger 20 and door 12 will open. With lock 39 rotated clockwise, lock cam 40 raises intermediate selector 34 in such manner that link 34' is rotated out of alignment with finger 20 and access door 12 will not open until sufficient additional coins are deposited in coin mechanism 18 to advance higher price cam 23 into a position of restraining relationship with finger 20.

It will be noted that as higher price cam 23 can be rotated either clockwise to lower or, counter-clockwise to raise the price in 5¢ increments, so also can lower price cam 33 be rotated in a like manner to raise or lower the price at which door 12 may be released. Thus with lock 39 in its most counter-clockwise position, newspapers are accessible at the lower of two prices and with said lock in its most clockwise position, newspapers are accessible only at the higher of two prices.

Having described the present invention in detail, it is obvious that one skilled in the art will be able to make modifications and variations thereto without departing from the scope of the invention. Accordingly, the scope of the present invention should be determined by the claims appended hereto.

What is claimed is:

1. A multiple price system for actuating a vending machine comprising: a housing containing a totalizer with a shaft that incrementally rotates in response to the insertion of coins, a multilobal price cam mounted to rotate with said shaft, an intermediate link pivotally mounted on said shaft, a product release means which when allowed to move in a path prevents the vending of products and when restricted from moving in said path allows the vending of products and a price selection device which cooperates with said intermediate link to pivot said link from a first position of non intervention to a second position of intervention along said path of the product release means, wherein said multilobal price cam, incrementally rotated by said totalizer, is so associated with said product release means that prior to a predetermined number of rotational increments said product release means remains unrestricted in said path by any lobe of said price cam and no product is made available or, subsequent to said predetermined number of rotational increments, said product release means is restricted in said path by a first lobe of said multilobal price cam making said product available and; wherein said intermediate link may be pivoted by said price selection device from said first position of nonintervention to said second position of intervention along said path of said product release means between a second lobe of said cam and said product release means in such a manner that said product is made available with fewer rotational increments of said price cam than said predetermined number of rotational increments.

2. A multiple price system as described in claim 1 wherein the vending machine is a newspaper vendor.

3. A multilobal price cam as described in claim 1 wherein said cam is an assembly comprised of interlocking segments provided with at least one interlocking appendage on one hand and, multiple mating holes on the other hand in such manner that segments may be seperated, rotated in respect to each other and rejoined to provide a variety of pricing arrangements.

4. A multiple price system as described in claim 1 wherein the position of said intermediate link is controlled by a selection device which extends through the wall of said housing.

* * * * *